US005234232A

United States Patent [19]

Fletcher

[11] Patent Number: 5,234,232

[45] Date of Patent: Aug. 10, 1993

[54] BOOKBINDING APPARATUS AND METHOD OF BINDING SHEETS

[75] Inventor: Glenn A. Fletcher, Marlton, N.J.

[73] Assignee: Stripbind, Inc., Marlton, N.J.

[21] Appl. No.: 816,029

[22] Filed: Dec. 30, 1991

[51] Int. Cl.[5] ..... B42D 1/00; B42D 13/14

[52] U.S. Cl. ..... 281/28; 402/63; 402/62; 402/68; 412/43

[58] Field of Search ..... 281/28; 402/62, 63, 402/68, 80 P; 412/7, 43

[56] References Cited

U.S. PATENT DOCUMENTS

| | | | |
|---|---|---|---|
| B-1 4,369,013 | 6/1988 | Abildgaard et al. . | |
| Re. 28,202 | 10/1974 | Abildgaard et al. . | |
| 773,659 | 11/1904 | Lottridge | 402/63 |
| 813,818 | 2/1906 | Nelson | 402/63 |
| 929,387 | 7/1909 | Chapman | 402/63 |
| 1,040,506 | 10/1912 | Byron | 402/63 |
| 2,099,881 | 11/1937 | Emmer . | |
| 2,116,078 | 5/1938 | Mevi . | |
| 2,129,318 | 9/1938 | Emery . | |
| 2,450,785 | 10/1948 | Emmer . | |
| 2,617,423 | 11/1952 | Miller . | |
| 3,569,929 | 8/1971 | Abildgaard et al. . | |
| 3,756,625 | 9/1973 | Abildgaard et al. . | |
| 3,970,331 | 7/1976 | Giulie . | |
| 3,972,085 | 8/1976 | Giulie | 412/43 |
| 4,305,675 | 12/1981 | Jacinto . | |
| 4,369,013 | 1/1983 | Abildgaard et al. . | |
| 4,374,627 | 2/1983 | Friedman . | |
| 4,405,250 | 9/1983 | Wu . | |
| 4,620,724 | 11/1986 | Abildgaard et al. . | |
| 4,674,906 | 6/1987 | Abildgaard . | |
| 4,685,700 | 8/1987 | Abildgaard . | |

FOREIGN PATENT DOCUMENTS

| | | | |
|---|---|---|---|
| 1436207 | 11/1968 | Fed. Rep. of Germany | 402/63 |
| 944178 | 3/1949 | France | 402/62 |
| 2455517 | 1/1981 | France | 402/63 |
| 61789 | 5/1968 | German Democratic Rep. | 402/68 |
| 950768 | 2/1964 | United Kingdom . | |
| 1250163 | 10/1971 | United Kingdom | 402/62 |
| 1400460 | 7/1975 | United Kingdom . | |

*Primary Examiner*—Paul A. Bell

*Attorney, Agent, or Firm*—John F. A. Earley; John F. A. Earley, III

[57] ABSTRACT

A bookbinding apparatus for binding together perforated sheets comprises a first strip, spaced-apart studs extending from the first strip, spaced-apart locking caps extending around each stud, a second strip, spaced-apart first openings extending through the second strip, each first opening being aligned with a corresponding stud of the first strip and each first opening having a size larger than the cross-section of the corresponding stud of the first strip to freely receive the stud, and a locking member formed on the second strip for locking the studs to the second strip, the locking member including second openings, each second opening being located next to and in partial contact with a first opening, and each second opening having a size smaller than the cross-section of the studs at a locking cap but larger than or equal to the cross-section of the studs between locking caps such that the second strip after receiving studs of the first strip with the first openings in the second strip locks the studs of the first strip to the second strip by being slid sideways.

17 Claims, 4 Drawing Sheets

BOOKBINDING APPARATUS AND METHOD OF BINDING SHEETS

BACKGROUND OF THE INVENTION

1. Field of the Invention

The present invention relates to the field of bookbinding, and is specifically concerned with bookbinding strips for binding together perforated sheets and the like, a method of binding perforated sheets with the bookbinding strips, and a book bound together with the bookbinding strips.

2. Description of the Prior Art

A variety of methods and bookbinding devices are known for holding a collection of pages or sheets together to form books, filings, price lists, catalogs, booklets, and the like.

For example, there are spiral devices and methods of bookbinding disclosed in Emmer U.S. Pat. Nos. 2,099,881 and 2,450,785, Mevi U.S. Pat. No. 2,116,078, and Friedman U.S. Pat. No. 4,374,627. Another example of the spiral device is the GBC (General Binding Corporation) plastic spiral comb. The spiral devices require large storage areas to store the different sizes (sometimes 16 different sizes) of combs, and this is a disadvantage.

Another bookbinding device is the loose-leaf binder, which uses spring-loaded semi-circular snap rings to hold a collection of pages together. An advantage of the loose-leaf binder is that the collection of pages held by the loose-leaf binder may be easily updated by opening the snap rings, removing the old page(s) from the opened snap rings, adding the updated page(s) to the opened snap rings, and closing the snap rings. Disadvantages of the loose-leaf binder include: (1) the fingers of the snap rings frequently become misaligned resulting in loss of or damage to the pages held in the loose-leaf binder, (2) loose-leaf binders are generally bulky since such binders have a ring mechanism, a spine panel, a front cover, and a back cover, and (3) the size of a standard loose-leaf binder is not adjustable to fit the thickness of the collection of pages being held in the loose-leaf binder.

Another device is a folding post binder, which has metal prongs that may be bent over and moveable slides or covers that hold the metal prongs in place. A disadvantage of the folding post binder is that the edges of the metal prongs sometimes are sharp, which is dangerous.

Abildgaard et al. U.S. Pat. Nos. Re 28,202, 4,369,013, and 4,620,724 disclose rigid plastic binding strips. Smooth studs formed on a first strip are inserted through perforated sheets and then through holes in a second strip. Then, pressure and/or heat is applied to the end of the studs to form a head which locks the strips and the sheets therebetween in assembled position. Abildgaard et al. binding strips require expensive mechanical equipment to create the heads on the studs, and these strips provide a permanent-type binding rather than an updatable-type binding.

Abildgaard et al. U.S. Pat. Nos. 4,674,906 and 4,685,700 disclose an updatable-type binding. Smooth studs formed on a first strip are inserted through perforated sheets and then through holes in a second strip. Then, the ends of the studs projecting from the holes in the second strip are bent over at a right angle into a groove to hold the first strip to the second strip. Binding thick books with such a binding is difficult because locking with the studs requires that the studs project far enough out of the holes in the second strip to permit bending of the studs.

Baumgart U.S. Pat. No. 950,768 and Giulie U.S. Pat. No. 3,970,331 also disclose binding strips. Studs formed on a first strip have teeth that engage a lip in a second strip to lock the first strip to the second strip. These ratchet-type devices require considerable and evenly distributed force to pass the studs of the first strip through the second strip, and once the devices are locked it is very difficult, if not impossible, to disengage the first strip from the second strip.

SUMMARY OF THE INVENTION

It is an object of the invention to provide a bookbinding apparatus for binding together perforated sheets and the like.

Another object of the invention is to provide a bookbinding apparatus that is easy to assemble and disassemble and that does not require expensive machinery to use.

Another object of the invention is to provide a bookbinding apparatus that overcomes some, and possibly all, of the disadvantages of the prior art mentioned above.

These and other objects are accomplished by providing a bookbinding apparatus for binding together perforated sheets and the like that comprises a first strip and a second strip. Spaced-apart studs are formed on and extend from the first strip, and spaced-apart locking caps are formed and extend around each stud. Spaced-apart first openings are formed in and extend through the second strip, and each first opening is aligned with a corresponding stud of the first strip. Each first opening has a size larger than a cross-section of the corresponding stud of the first strip to freely receive that stud. Locking means are formed on the second strip for locking the studs to the second strip, and the locking means include second openings formed in and extending through the second strip. Each second opening is located next to and in partial contact with a first opening, and each second opening has a size smaller than the cross-section of the studs at a locking cap but larger than or equal to the cross-section of the studs between locking caps such that the second strip after receiving studs of the first strip with the first openings in the second strip locks the studs of the first strip to the second strip by being slid sideways forcing the second openings of the second strip to surround the studs below a locking cap.

DETAILED DESCRIPTION OF THE DRAWINGS

Figure 1:
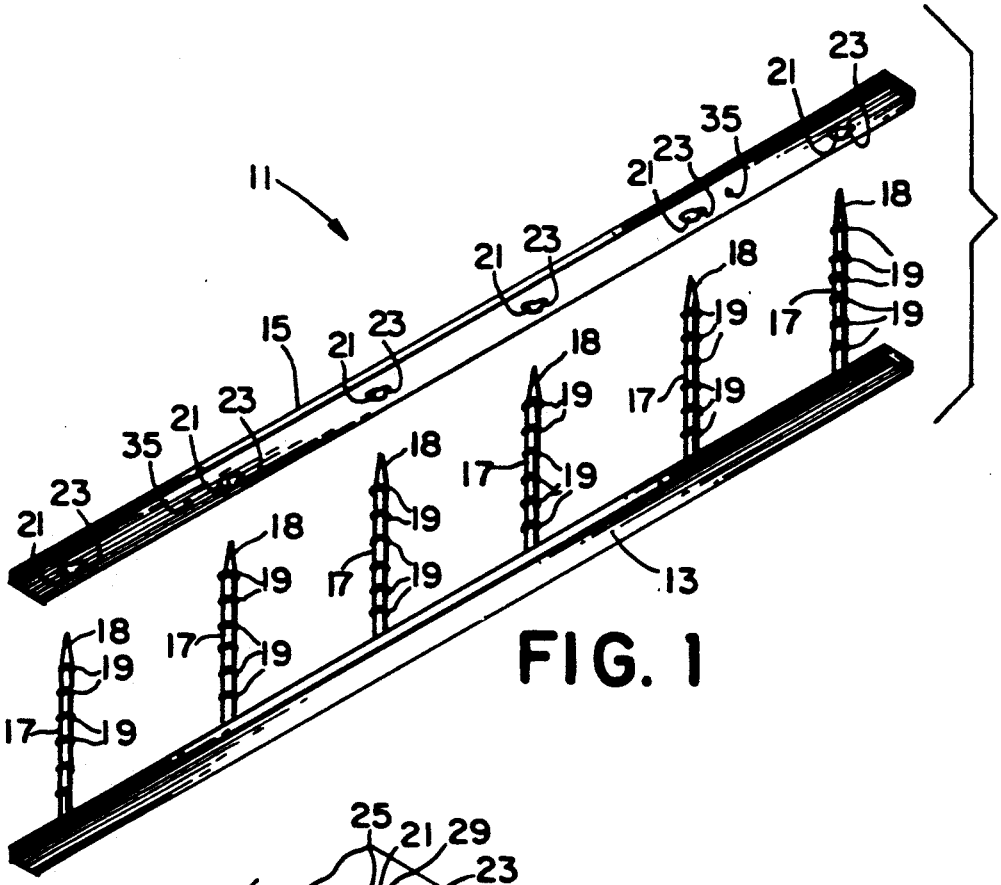
FIG. 1 is a view in perspective of a bookbinding apparatus constructed in accordance with the invention.
Figure 2:
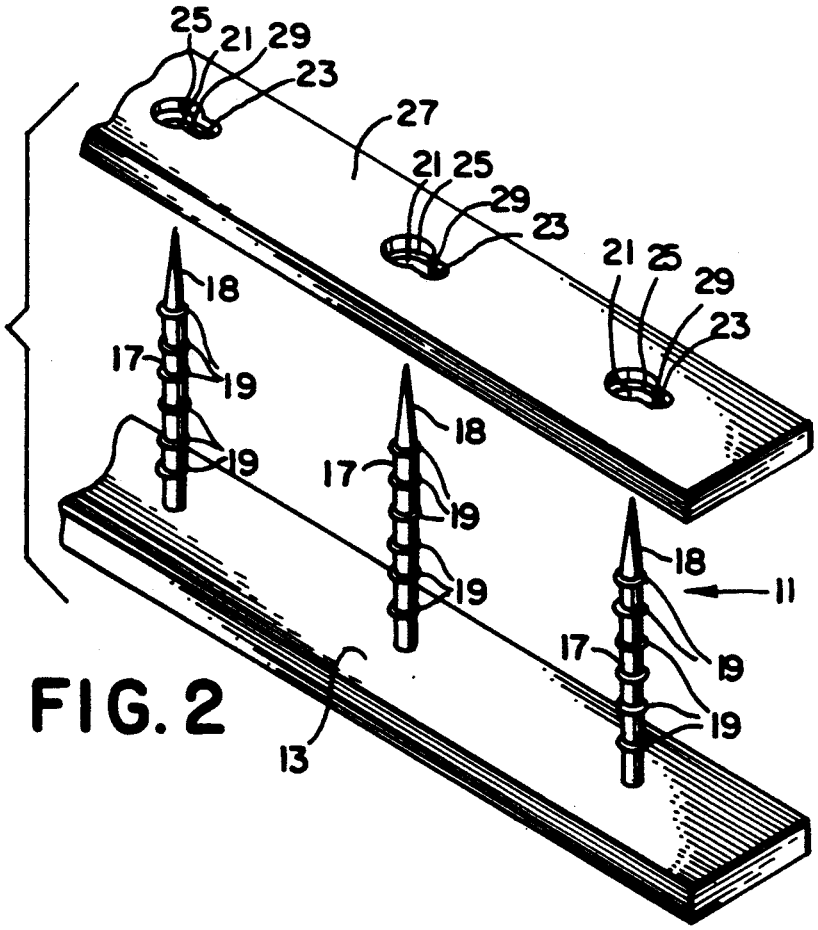
FIG. 2 is another view in perspective of a bookbinding apparatus constructed in accordance with the invention.

Turning to the drawings, there is shown in FIGS. 1 and 2 a bookbinding apparatus 11 for binding together perforated sheets and the like, which comprises a first strip 13, and a second strip 15.

Spaced-apart studs 17 are formed on and are integral with first strip 13, and studs 17 extend outwardly from first strip 13 to receive the sheets. Each stud 17 has a tapered end 18 to promote easy penetration of studs 17 through the perforations in the sheets being bound.

A series of locking caps or 19 are formed on and extend around each stud 17.

Second strip 15 is provided with a series of spaced-apart first openings 21 that are formed in and that extend through second strip 15. Each first opening 21 is aligned with a corresponding stud 17 of first strip 13, and each first opening 21 has a size larger than the cross-section of the corresponding stud 17 of first strip 13 to freely receive said stud 17.

A series of second openings 23 also are formed in and extend through second strip 15 for locking studs 17 to second strip 15. Each second opening 23 is located next to and in partial contact with a first opening 21. Each second opening 23 has a size smaller than the cross-section of the studs 17 at a locking cap 19 but larger than or equal to the cross-section of the studs 17 between locking caps 19 such that second strip 15, after receiving studs 17 with its first openings 21, locks the studs 17 of first strip 13 to second strip 15 by being slid sideways forcing the second openings 23 in second strip 15 to surround studs 17 below a locking cap 19.

Figures 3, 4, 5, 6, 7:
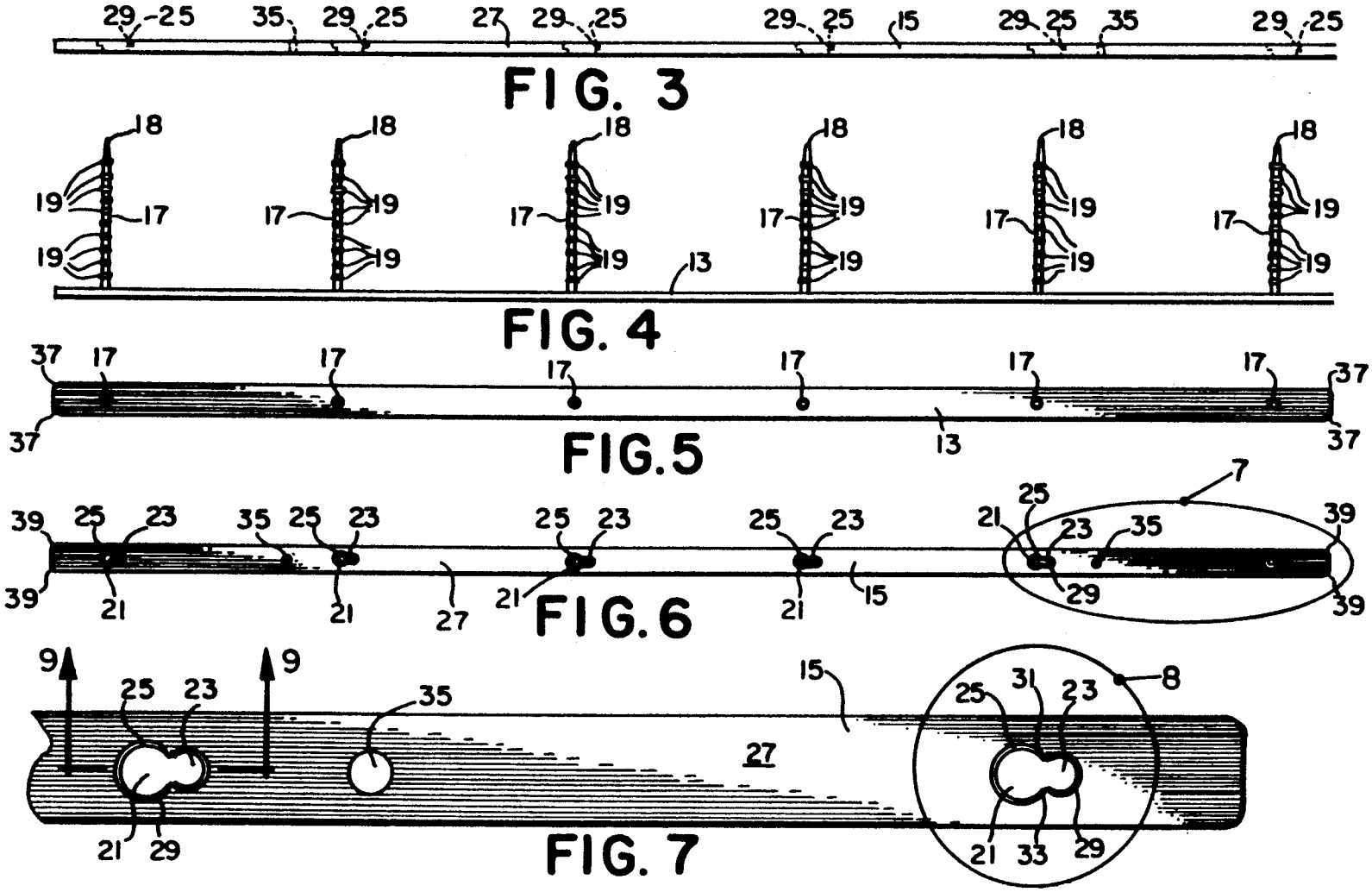
FIG. 3 is a view in side elevation of a second strip constructed in accordance with the invention.
FIG. 4 is a view in side elevation of a first strip constructed in accordance with the invention.
FIG. 5 is a view in top plan of the first strip shown in FIG. 4.
FIG. 6 is a view in top plan of the second strip shown in FIG. 3.
FIG. 7 is a fragmentary enlargement taken as indicated by the circle 7 which appears in FIG. 6.
Figure 8:
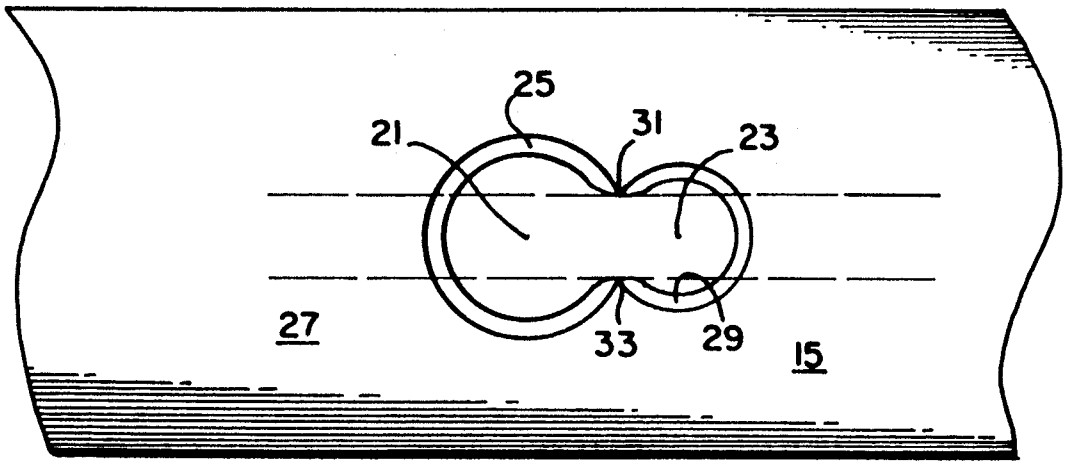
FIG. 8 is a fragmentary enlargement taken as indicated by the circle 8 which appears in FIG. 7.
Figure 9:
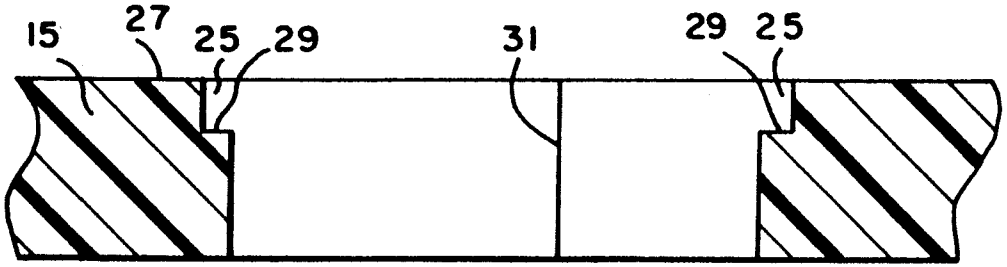
FIG. 9 is a view in cross-section taken along the lines and arrows 9—9 of FIG. 7.
Figure 10:
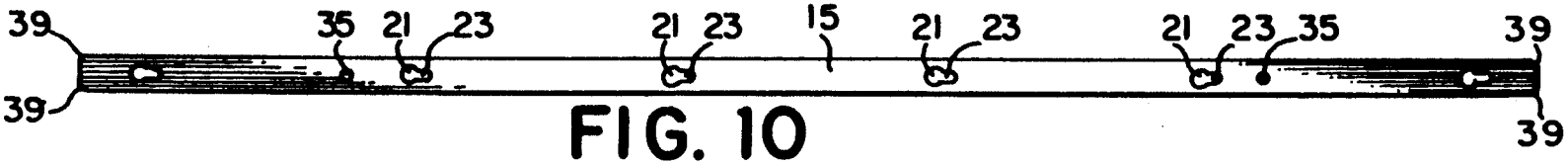
FIG. 10 is a view in bottom plan of the second strip shown in FIG. 3.

As seen in FIGS. 2, 3, and 6, and more particularly in FIGS. 7, 8 and 9, a series of recesses 25 is formed in the outer surface 27 of second strip 15 around the periphery of each first opening 21 and each second opening 23. Each recess 25 forms a ledge 29, and a locking cap 19 rests against the portion of ledge 29 surrounding second opening 23 when stud 17 is in locking position, that is, when a stud 17 is positioned in second opening 23. Preferably, ledge 29 is slightly wider than the flanged portion of locking cap 19. Also, the portion of each recess 25 surrounding each second opening 23 is sized to receive a locking cap 19 so that the locking cap 19 is countersunk into second strip 15 when stud 17 is positioned in second opening 23.

Figure 12A:
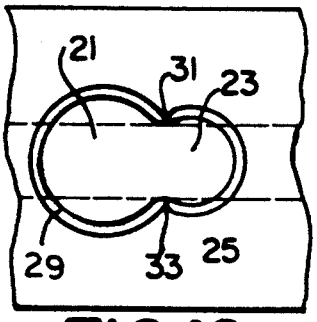
FIGS. 12*a*, 12*b*, and 12*c* are partial views in top plan of the second strip which illustrate the sequence of how the second strip is locked onto a stud.

Referring to FIGS. 7, 8 and 12, opposing first and second pinch-point segments 31 and 33 are formed in second strip 15 where each first opening 21 overlaps each second opening 23. Preferably, when the first strip 13, including studs 17, and/or the second strip 15 are made of a resilient material, each first pinch-point segment 31 is spaced from each opposing second pinch-point segment 33 by a distance slightly smaller than the cross-section of stud 17 between locking caps 19 to aid in locking second strip 15 to stud 17. That is, when second strip 15 is resilient, pinch-point segments 31 and 33 are pushed away from one another as stud 17 passes between pinch-point segments 31 and 33 and into second opening 23, and pinch-point segments 31 and 33 flex back toward their original positions as stud 17 moves into second opening 23 to hold stud 17 in second opening 23, the distance between pinch-point segments 31 and 33 again becoming smaller than the cross-section of stud 17 between locking caps 19. Similarly, when stud 17 is resilient, stud 17 is squeezed past pinch-point segments 31 and 33, stud 17 rebounding to its original cross-section when received in second opening 23 and being held in second opening 23 by pinch-point segments 31 and 33.

However, no matter what material strips 13 and 15 are made of, the distance separating pinch-point segment 31 from pinch-point segment 33 may be the same as or larger than the cross-section of a stud 17 between locking caps 19.

Holes 35 are formed in second strip 15 for engaging a locating pin in a bookbinding machine such as the bookbinding machine disclosed in Abildgaard U.S. Pat. No. 3,756,625 when a bookbinding machine is used to assemble the book, to keep the sheets being bound and strips 13 and 15 in alignment with one another.

For cosmetic reasons, first strip 13 is provided with rounded corners 37 and second strip 15 is provided with rounded corners 39.

Figure 11A:
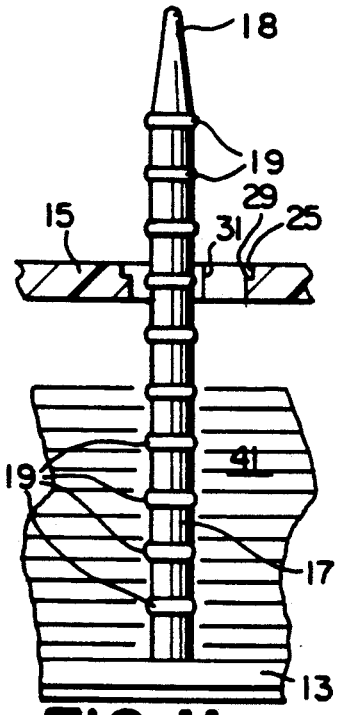
FIGS. 11*a*, 11*b*, and 11*c* are views in cross-section illustrating the method of binding a book in accordance with the invention.
Figure 11B:
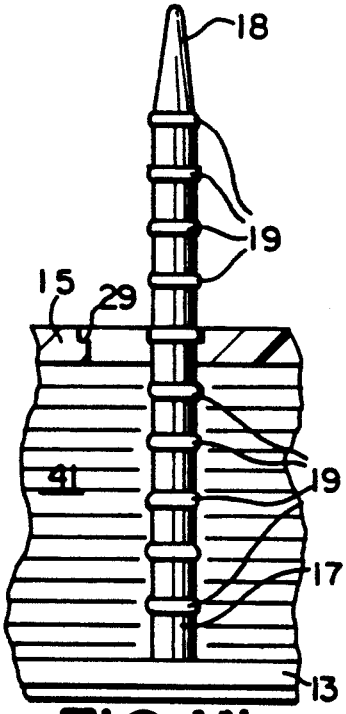
Figure 11C:
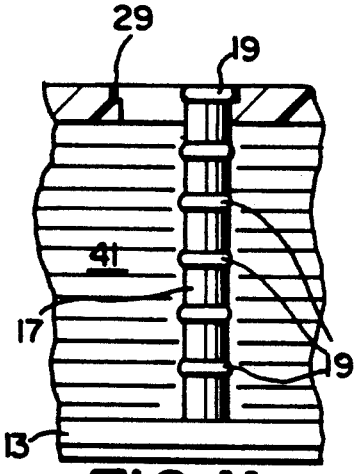

In use, as shown in FIGS. 11 and 12, studs 17 of first strip 13 are inserted through corresponding perforations in the sheets 41 being bound.

Then, studs 17 are inserted through corresponding first openings 21 in second strip 15 to sandwich sheets 41 between first strip 13 and second strip 15.

Figure 12B:
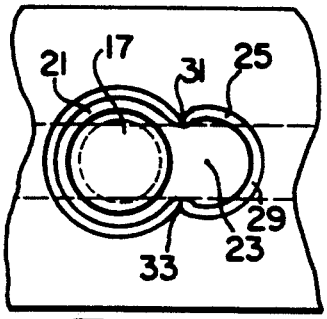
Figure 12C:
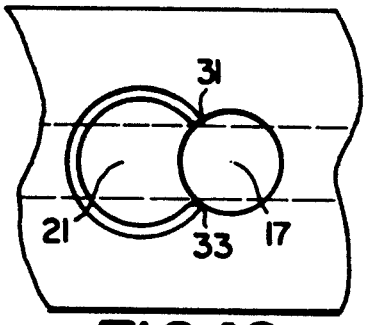

Preferably, first strip 13 and second strip 15 are then pressed tightly towards each other, and second strip 15 is slid sideways to force the second opening 23 in second strip 15 to surround the corresponding studs 17 below a locking cap 19, thereby locking the second strip 15 to studs 17. FIGS. 11*a* and 12*b* show second strip 15 receiving a stud 17 in first opening 21 before second strip 15 is locked on stud 17 and FIGS. 11*b* and 12*c* show second strip 15 locked onto stud 17 after second strip 15 has been slid to the left in the drawings.

When studs 17 are positioned in second openings 23, studs 17 are locked to second strip 15, thereby binding sheets 41 together, because sheets 41, after being compressed together between first strip 13 and second strip 15, push outwardly against first strip 13 and second strip 15, because force is required to slide second strip 15 sideways to disengage from the locking position, and because force is required to pass stud 17 between the pinch-point segments 31 and 33 back into first opening 21 when the distance between the opposing pinch-point segments 31 and 33 is smaller than the cross-section of the stud 17 between locking caps 19.

As shown in FIG. 11*b*, each stud 17 may be cut or clipped above the locking cap 19 positioned against the outer surface of second strip 15 to remove any excess portion of each stud 17 and provide a smooth finish. Since said locking cap 19 sits in recess 25, when each stud 17 is so cut, the top portion of the outermost locking cap 19 remaining on stud 17 is flush with the outer surface of strip 15.

Optionally, heat from a heat source such as an iron may be applied to each locking cap 19 positioned against the outer surface of second strip 15, that is, to the outermost locking cap 19 remaining on stud 17 after cutting, to melt each of said locking caps 19 to second strip 15 to solidify the bind.

If the heating step is not used in binding the sheets together, a book may be disassembled by sliding second strip 15 sideways to force studs 17 into first openings 21, sliding second strip 15 off studs 17, and removing the perforated sheets from studs 17. Accordingly, the book may be updated by replacing old pages with new pages, and then easily reassembled.

If it is desired to reduce the number of sheets in a book bound in accordance with the invention, the book may be disassembled as explained above and then reassembled with fewer sheets. Any excess portion of each stud 17 may be cut or clipped off to provide a smooth finish.

If it is desired to add sheets to a book assembled in accordance with the invention, the book may be disassembled as described above and then reassembled as described above using a new first strip 13.

Preferably, strips 13 and 15 are molded from a resilient thermoplastic material. However, strips 13 and 15 maybe made of other materials, such as steel, aluminum, wood, and the like.

Figure 13:
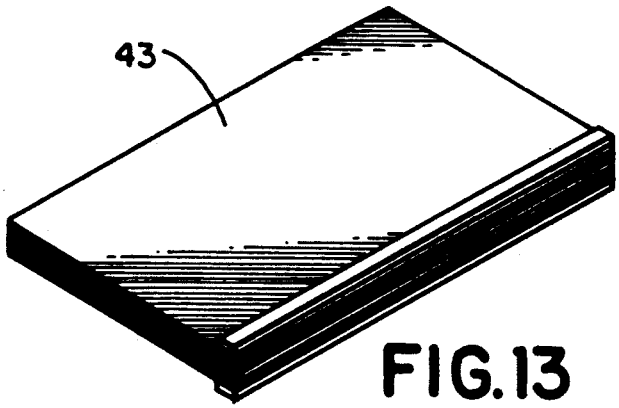
FIG. 13 is a view in perspective of a book constructed in accordance with the invention.

A book, constructed in accordance with the invention, such as a book 43 shown in FIG. 13, comprises a plurality of sheets each having spaced-apart holes spaced along a spine edge of each sheet, and the bookbinding apparatus 11 mounted on the spine edges of the sheets. The sheets may be paper, plastic, cardboard, fabric, and the like.

ADVANTAGES

Unlike many known bookbinding strips, no expensive machinery is needed to mount bookbinding apparatus 11 onto the sheets. Further, the use of heat and messy glues is not needed.

The method of binding together sheets with the inventive bookbinding apparatus 11 is quick and easy, and the method requires no expensive equipment or technical knowledge. Further, books bound using the inventive method may be updated quickly and easily.

Bookbinding apparatus 11 is preferably made of inexpensive thermoplastic material, so it may be made by injection molding in large quantities at low cost.

Bookbinding apparatus 11 is very durable and attractive, and bookbinding apparatus 11 may be molded in a variety of colors.

Substantially the entire surface area of each sheet bound in bookbinding apparatus 11 may be viewed since bookbinding apparatus 11 may be bound close to the edge of each sheet so as not to obscure information appearing on the sheets.

Bookbinding apparatus 11 tightly binds sheets together so the problem of sheets being accidently torn out of the binding during handling is practically eliminated.

Bookbinding apparatus 11 may be used to bind books having a thickness from thin to thick, and since strips 13 and 15 lie snugly against the outer sheets of books constructed in accordance with the invention, such books are easier to file and to mail than typical loose-leaf type bookbindings since the books constructed in accordance with the invention take up less space than the typical loose-leaf type bookbindings.

Further, if updating of a book is necessary, bookbinding apparatus 11 is disassembled easily to permit sheets to be added or removed from the book, and after updating, bookbinding apparatus 11 is easily reassembled.

Since very little space is needed to assemble a book constructed in accordance with the invention, said books may be constructed almost anywhere, such as in an airplane or train, or in school, the office, or the home.

I claim:

1. A book comprising a plurality of sheets each having spaced-apart holes spaced along a spine edge of each sheet, and a bookbinding device mounted on the spine edges of the sheets for binding together the sheets, the bookbinding device including a first strip, spaced-apart studs formed on and extending from the first strip through the spaced-apart holes in the sheets, spaced-apart locking caps formed on and extending around each stud, a second strip, spaced-apart first openings formed in and extending through the second strip, each first opening being aligned with a corresponding stud of the first strip and each first opening having a size larger than the cross-section of the corresponding stud of the first strip to freely receive said stud, the first strip and/or the second strip being made of a resilient material, and locking means formed on the second strip for locking the studs to the second strip, the locking means including second openings formed in and extending through the second strip, each second opening being located next to and in partial contact with a first opening, and each second opening having a size smaller than the cross-section of the studs at a locking cap but larger than or equal to the cross-section of the studs between locking caps such that the second strip after receiving studs of the first strip with the first openings in the second strip locks the studs of the first strip to the second strip by being slid sideways forcing the second openings in the second strip to surround the studs below a locking cap, and a series of first pinch-point segments formed in the second strip, and a series of second pinch-point segments formed in the second strip, each first pinch-point segment being located opposite a corresponding second pinch-point segment where each first opening overlaps each second opening at a distance smaller than the cross-section of the studs between locking caps.

2. The book of claim 1, the second strip having an inner surface and an outer surface, further including a series of recesses formed in the outer surface of the second strip around the periphery of each second opening, each recess being sized to receive a locking cap of a stud.

3. The book of claim 1, the first strip being an integral piece of thermoplastic material.

4. A bookbinding device for binding together perforated sheets and the like, comprising a first strip, spaced-apart studs formed on and extending from the first strip, spaced-apart locking caps formed on and extending around each stud, a second strip, spaced-apart first openings formed in and extending through the second strip, each first opening being aligned with a corresponding stud of the first strip and each first opening having a size larger than the cross-section of the corresponding stud of the first strip to freely receive said stud, and locking means formed on the second strip for locking the studs to the second strip, the locking means including second openings formed in and extending through the second strip, each second opening being located next to and in partial contact with a first opening, and each second opening having a size smaller than the cross-section of the studs at a locking cap but larger than or equal to the cross-section of the studs between locking caps such that the second strip after receiving studs of the first strip with the first openings in the second strip locks the studs of the first strip to the second strip by being slid sideways forcing the second openings in the second strip to surround the studs below a locking cap, the second strip having an inner surface and an outer surface, further including a series of recesses formed in the outer surface of the second strip around the periphery of each second opening, each recess being sized to receive a locking cap of a stud, the first strip being an integral piece of resilient thermoplastic material, the second strip being made of a resilient material, and further including a series of first pinch-point segments formed in the second strip, and a series of second pinch-point segments formed in the second strip, each first pinch-point segment being located opposite a corresponding second pinch-point segment where each first opening overlaps each second opening at a distance smaller than the cross-section of the studs between locking caps.

5. A bookbinding device for binding together perforated sheets and the like, comprising a first strip, spaced-apart studs formed on and extending from the first strip, spaced-apart locking caps formed on and extending around each stud, a second strip, spaced-apart first openings formed in and extending through the second strip, each first opening being aligned with a corresponding stud of the first strip and each first opening having a size larger than the cross-section of the corresponding stud of the first strip to freely receive said stud, the first strip and/or the second strip being made of a resilient material, and locking means formed on the second strip for locking the studs to the second strip, the locking means including second openings formed in and extending through the second strip, each second opening being located next to and in partial contact with a first opening, and each second opening having a size smaller than the cross-section of the studs at a locking cap but larger than or equal to the cross-section of the studs between locking caps such that the second strip after receiving studs of the first strip with the first openings in the second strip locks the studs of the first strip to the second strip by being slid sideways forcing the second openings in the second strip to surround the studs below a locking cap, and a series of first pinch-point segments formed in the second strip, and a series of second pinch-point segments formed in the second strip, each first pinch-point segment being located opposite a corresponding second pinch-point segment where each first opening overlaps each second opening at a distance smaller than the cross-section of the studs between locking caps.

6. The bookbinding device of claim 5, the second strip having an inner surface and an outer surface, further including a series of recesses formed in the outer surface of the second strip around the periphery of each second opening, each recess being sized to receive a locking cap of a stud.

7. The bookbinding device of claim 5, the first strip being an integral piece of thermoplastic material.

8. The bookbinding device of claim 5, the second strip being an integral piece of thermoplastic material.

9. A method of binding together perforated sheets and the like with a bookbinding device having a first strip, spaced-apart studs formed on and extending from the first strip, spaced-apart locking caps formed on and extending around each stud, a second strip, spaced-apart first openings formed in and extending through the second strip, each first opening being aligned with a corresponding stud of the first strip and each first opening having a size larger than the cross-section of the corresponding stud of the first strip to freely receive said stud, the first strip and/or the second strip being made of a resilient material, and locking means formed on the second strip for locking the studs to the second strip, the locking means including second openings formed in and extending through the second strip, each second opening being located next to and in partial contact with a first opening, and each second opening having a size smaller than the cross-section of the studs at a locking cap but larger than or equal to the cross-section of the studs between locking caps such that the second strip after receiving studs of the first strip with the first openings in the second strip locks the studs of the first strip to the second strip by being slid sideways forcing the second openings in the second strip to surround the studs below a locking cap, and a series of first pinch-point segments formed in the second strip, and a series of second pinch-point segments formed in the second strip, each first pinch-point segment being located opposite a corresponding second pinch-point segment where each first opening overlaps each second opening at a distance smaller than the cross-section of the studs between locking caps, comprising the steps of inserting the studs of the first strip through corresponding perforations in the sheets, inserting the studs of the first strip through corresponding first openings in the second strip to sandwich the sheets between the first strip and the second strip, and locking the second strip to the studs of the first strip by sliding the second strip sideways to force the studs past the corresponding first and second pinch-point segments and into second openings in the second strip to surround the corresponding studs below a locking cap.

10. The method of claim 9, further including cutting each stud above the locking cap positioned immediately above the second opening to remove any excess portion of each stud and provide a smooth finish.

11. The method of claim 10, further including applying heat to each locking cap positioned immediately above each second opening in the second strip to melt each locking cap to the second strip to solidify the bind.

12. The method of claim 9, the second strip of the bookbinding device having an inner surface and an outer surface, the outer surface of the second strip having a series of recesses formed in it surrounding the periphery of each second opening in the second strip, and each recess being sized to receive a locking cap of a stud.

13. The method of claim 12, further including cutting each stud above the locking cap positioned immediately above the second opening to remove any excess portion of each stud and provide a smooth finish.

14. The method of claim 13, further including applying heat to each locking cap positioned immediately above each second opening in the second strip to melt each locking cap to the second strip to solidify the bind.

15. The method of claim 9, the first strip being an integral piece of thermoplastic material.

16. The method of claim 9, the second strip being an integral piece of thermoplastic material.

17. The book of claim 1, the second strip being an integral piece of thermoplastic material.

* * * * *